United States Patent [19]

Thomsen et al.

[11] Patent Number: 4,522,531

[45] Date of Patent: Jun. 11, 1985

[54] TRANSVERSE JOINT CELL FOR CONCRETE STRUCTURES

[76] Inventors: Bernard D. Thomsen, 117 S. Mayfair Dr., Mankato, Minn. 56001; Kenneth L. Thomsen, 11623 Palmer Rd., Minneapolis, Minn. 55437

[21] Appl. No.: 495,776

[22] Filed: May 18, 1983

[51] Int. Cl.[3] ..... E01C 11/02; E01F 5/00

[52] U.S. Cl. ..... 404/2; 404/49; 404/60; 404/62; 404/68

[58] Field of Search ..... 404/49, 50, 51, 52, 404/56, 60, 62, 63, 2, 68; 52/396

[56] References Cited

U.S. PATENT DOCUMENTS

| | | | |
|---|---|---|---|
| 1,040,731 | 10/1912 | Moore | 404/54 |
| 1,289,688 | 12/1918 | Davis | 404/68 |
| 1,566,319 | 12/1925 | Fischer | 404/61 |
| 1,586,326 | 5/1926 | Older | 404/51 |
| 1,806,275 | 5/1931 | Adler | 404/50 |
| 1,880,725 | 10/1932 | Bleck | 404/61 X |
| 2,025,449 | 12/1935 | Heltzel | 404/74 |
| 2,040,367 | 5/1936 | Eichelman et al. | 404/63 |
| 2,042,524 | 6/1936 | Hall et al. | 404/57 X |
| 2,082,805 | 6/1937 | Methven | 404/63 |
| 2,152,751 | 4/1939 | Schulz | 404/58 |
| 2,197,438 | 4/1940 | Ridgely | 404/62 |
| 2,208,000 | 7/1940 | Geyer | 404/2 |
| 2,224,148 | 12/1940 | Fischer | 404/61 |
| 2,269,449 | 1/1942 | Fischer | 404/49 |
| 2,269,703 | 1/1942 | Bagwill | 404/60 |
| 2,349,910 | 5/1944 | Methven | 404/2 |
| 2,365,550 | 12/1944 | Heltzel | 404/59 |
| 2,649,720 | 8/1953 | Heltzel | 404/2 |
| 2,674,164 | 4/1954 | Brickman | 404/63 |
| 2,700,329 | 1/1955 | Carter | 404/49 |
| 2,839,973 | 6/1958 | Heltzel | 404/2 |
| 3,059,553 | 10/1962 | Woolley | 404/62 |

*Primary Examiner*—Stephen J. Novosad
*Assistant Examiner*—Beverly E. Hjorth
*Attorney, Agent, or Firm*—Schroeder & Siegfried

[57] ABSTRACT

A transverse concrete pavement joint cell including a pair of plastic walls abutting the edges of the concrete joints. A seamless drainage gutter extends longitudinally between said plastic walls to the edges of the pavement. Blocks of compressible elastomers between said plastic walls absorb expansion of the concrete. The cell includes a base and stabilizing ties secured to a conventional dowel bar assembly.

22 Claims, 8 Drawing Figures

11
12
13
15
16
17
20
22
23
24
25
26
27
28
35
36
37
38
39
40
41
73

31
33
21
30
13
24
17
11
12
16
35
15
73

13
17
53
54
50
60
57
16
51
35
65
61
67
64
66
63
78
77
75
70
71
76

TRANSVERSE JOINT CELL FOR CONCRETE STRUCTURES

DESCRIPTION

1. Field of the Invention

This invention relates to transverse load transfer joints between adjacent concrete pavement sections.

2. Description of the Prior Art

Doweled transverse joints are designed to provide load transfer between adjacent concrete panels, confine payment cracking to predetermined locations directly over dowel bar assemblies and prevent faulting at the joints in concrete pavements. Causes of deterioration of major concrete pavements include increased loading on the pavement, damage due to expansion of collected water upon freezing, increased use of sand and chemicals and expansion and contraction of the pavement panels.

The upper portions of transverse joints are designed to accept joint sealants to resist the intrusion of materials within the joint area. The joints must be periodically resealed due to their limited service life. Failure of the joints usually begins within a year or two after sealing. The joint area then becomes susceptible to moisture, chemicals and non-compressible materials. The deterioration often goes unnoticed at the surface area for many years. The deterioration usually begins with a small triangle of deterioration forming at the joint base at subgrade level and with the upper apex of the triangle at the joint below the surface of the concrete pavement.

A deterioration triangle eventually appears at the surface area of the concrete panel. By this time there is very little rigid concrete surface in the vicinity of the transverse joint. Prior art joints include transverse steel dowel bars to provide load transfer. The underlying dowel bar assembly retains little of its original function due to the lack of durable supporting concrete. Before the deterioration triangle appears on the upper surface, the joint has become susceptible to the entrance of non-compressible materials.

Non-compressible materials enter the joint from the upper surface and from the underlying subgrade restricting the joint between adjacent concrete panels from closing. This restriction causes undue stress as the adjacent concrete panels expand. The resultant lack of ability to compensate for expansion in the joint causes internal stresses to develop in the lower portion of the concrete.

When moisture and chemicals are allowed to migrate through the transverse joint area, the supporting subgrade becomes more elastic. Increased elasticity in the road bed causes stress in the joint area. Bending of the rigid steel dowel bars due to load transfer and traffic vibration hastens concrete deterioration. Moisture also causes migration of fine soil out of the joint area in the subgrade. The soil becomes less dense, and the subgrade provides less support for the pavement, resulting in concrete deterioration.

It is an object of this invention to provide a transverse joint cell which provides resistance to deterioration of concrete and provides longer lasting load transfer between adjacent concrete panels.

SUMMARY OF THE INVENTION

The transverse joint cell of the invention are designed to attach to current dowel bar assemblies and functions to provide improved load transfer between adjacent concrete panels. The transverse joint cells consists of two symmetrical plastic wall liners in an upright joint forming cell which will attach to the existing dowel bar assemblies.

The wall liners seal off the adjacent side walls of the concrete structure from moisture and chemicals. It forms an open cell which allows water, chemicals and noncompressibles to migrate to a lower drainage trough which funnels these materials to the outside ends of the joint. The uppermost portion of the wall liners forms an open guide channel to receive a joint forming head which completes the concrete joint through the entire pavement structure.

The drainage trough is preferably an extruded flexible plastic section which is field formed as a seamless drainage trough through the entire paving width. The drainage trough is preferably received in channels provided on the lower portion of the inner walls of the plastic wall liner. Lateral movement of moisture, chemicals and non-compressibles is provided to adjacent underground edge drainage systems. The drainage trough is preferably sized to permit periodic flushing with high pressure water jet and vaccuum system. The drainage trough should therefore be accessible at both ends of the transverse joints. The drainage trough is preferably raised above the pavement subgrade to prevent its damage.

Compression blocks, preferably formed of natural rubber to provide compressibility, are placed in the open cell formed between the symmetrical sections of the wall liner. The compression blocks are placed between the dowel bars which extend through the wall liners and are spaced from each other to allow vertical movement of moisture, chemicals and noncompressible material to the drainage trough. The compression blocks function as spacers between the adjacent wall liners during the concrete pouring operation. Blocks are preferably constructed of compressible plastic material which will allow the joint to close to approximately two-thirds of the pavement joint width. Such a compression range allows the adjacent concrete slabs to expand during high temperature conditions, eliminating concrete blow-ups. When the concrete shrinks, the blocks rebound providing constant contact between the concrete joint edges and the plastic walls.

BRIEF DESCRIPTION OF THE DRAWINGS

A detailed description of the invention, including its preferred embodiment, is hereinafter described with specific reference being made to the drawings in which.

DETAILED DESCRIPTION OF THE INVENTION

Figure 1:
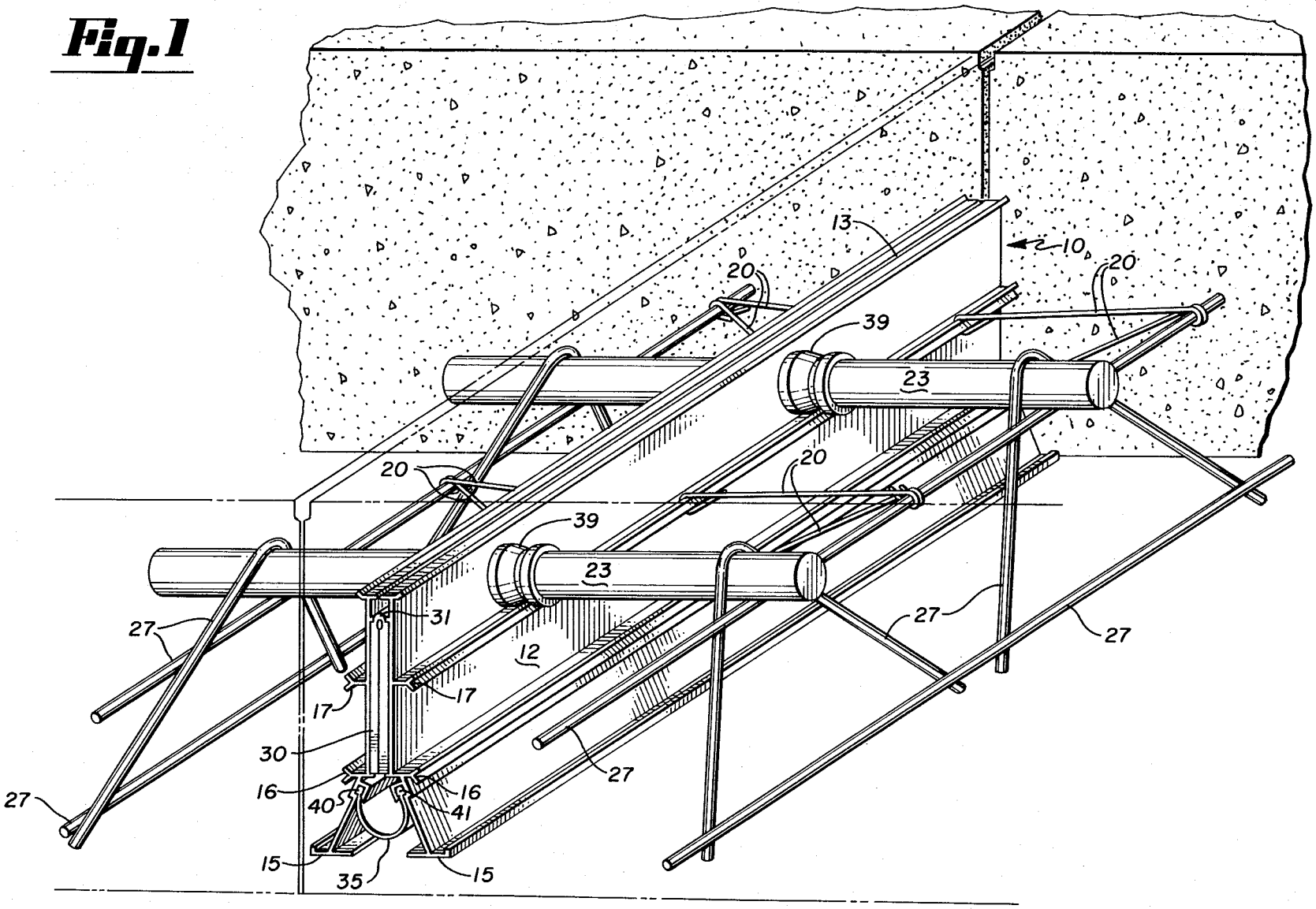
FIG. 1 is a pictorial view in cabinet projection of a joint with portions of the concrete mass indicated by phantom lines.
Figures 2, 2A, 2B:
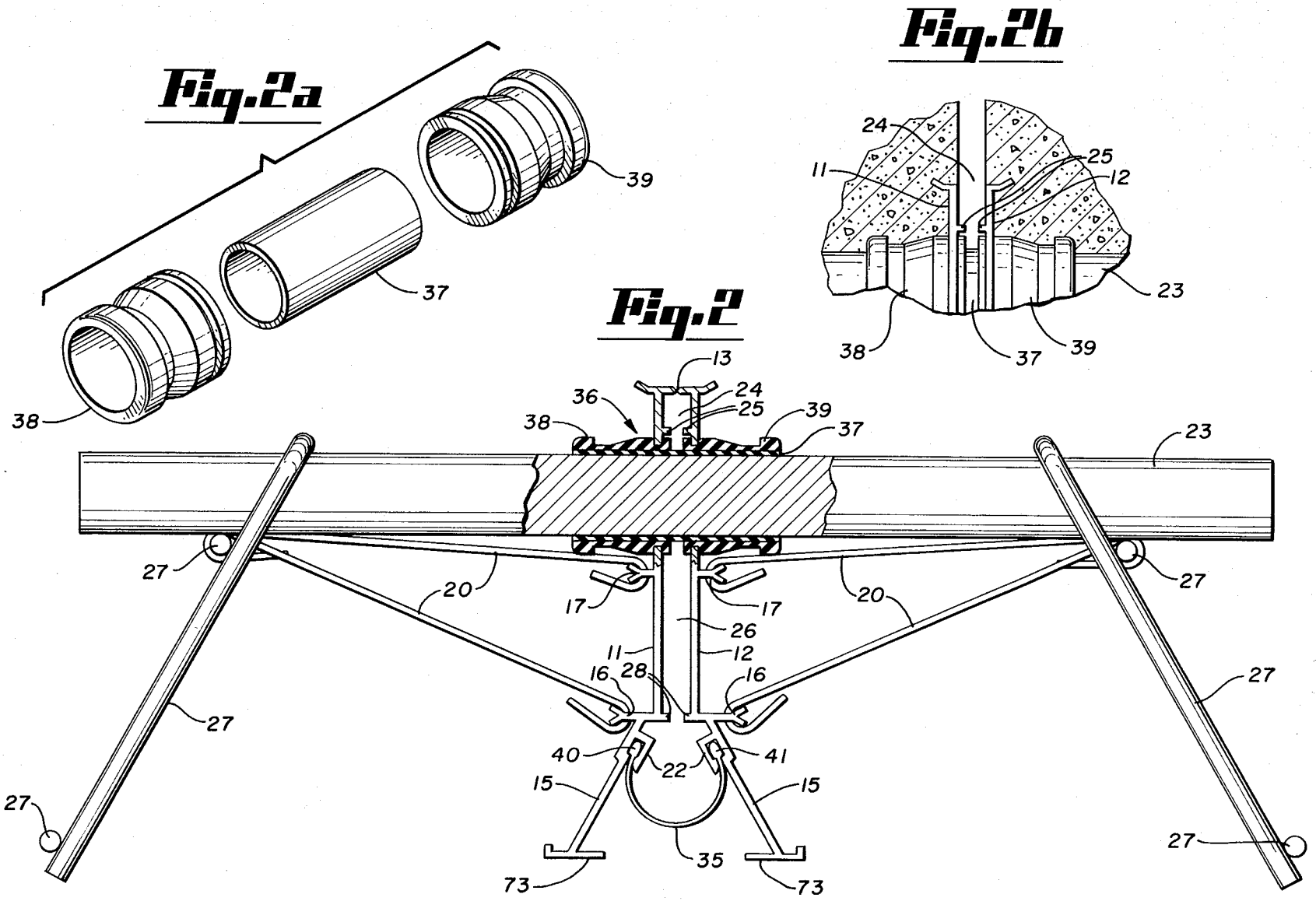
FIG. 2 is a side elevational view of the elements of a joint with parts broken away and shown in cross section.
FIG. 2*a* is a pictorial view of seals in isometric and exploded.
FIG. 2*b* is a fragmentary detail of the central portion of FIG. 2 with concrete in place and slotted.
Figure 3:
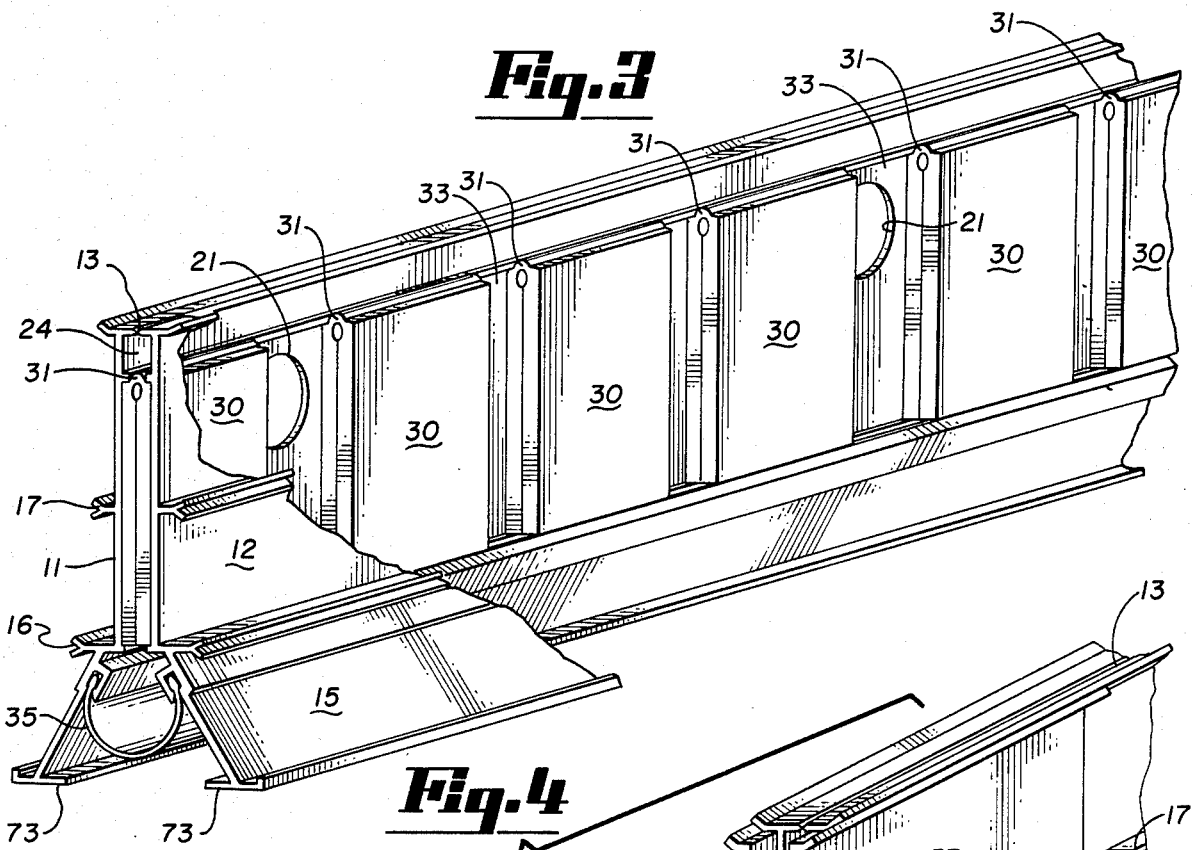
FIG. 3 is a pictorial view of a joint extrusion assembly in cabinet projection with parts broken away.

Referring to FIGS. 1, 2 and 3, wall liner 10 is formed of two symmetrical elongated side walls 11 and 12. Preferably, wall liner 10 is a plastic extrusion formed as a single unit joined at hinge 13. Plastic, as used herein, includes thermoplastic and thermosetting polymers. The preferred plastic, such as polypropylene and polyethylene, is resistant to road chemicals and has a coefficient of expansion compatible with concrete.

Figure 6:
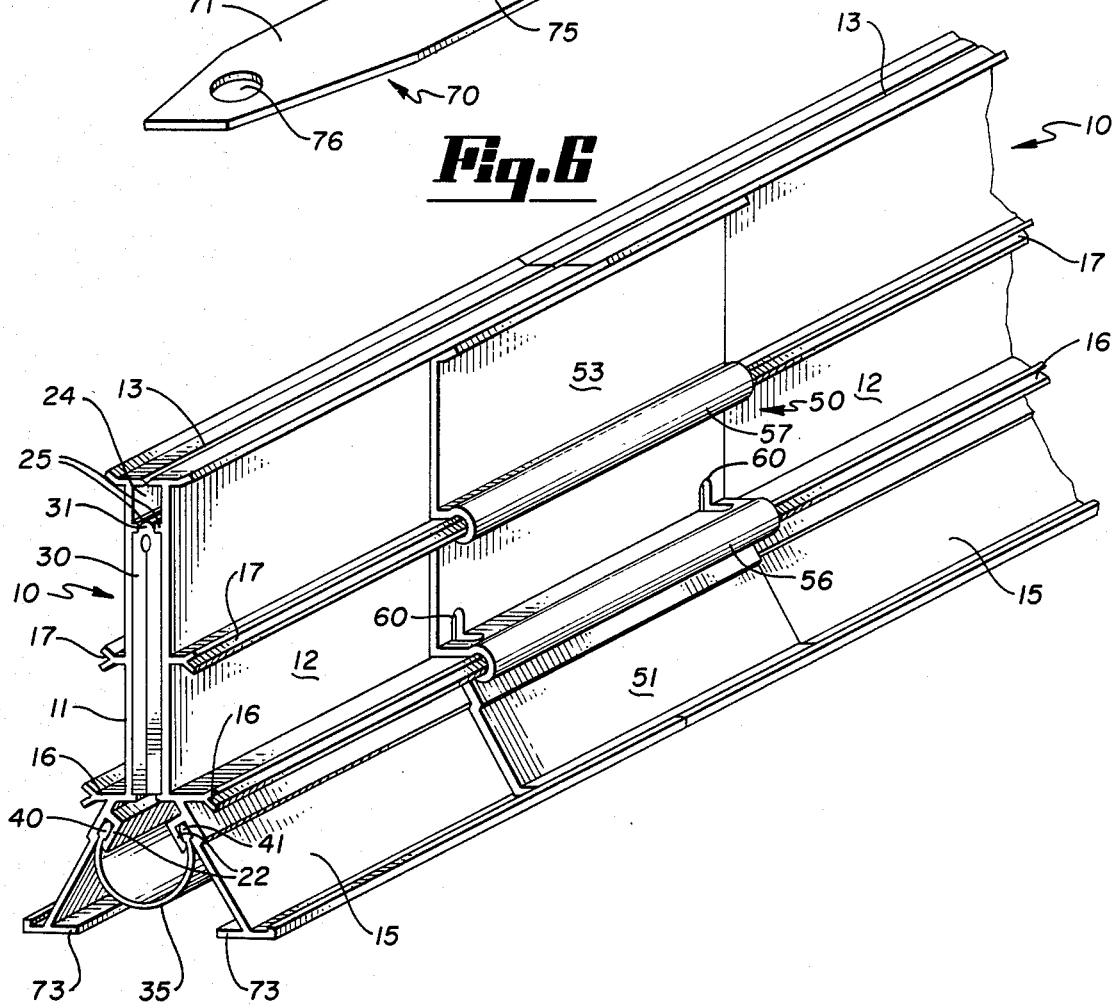
FIG. 6 is a pictorial view in cabinet projection of a connector section.

Wall liner 10 includes base feet 15 at the bottom of side wall 11, 12 to provide support. Wall liner 10 includes embedment ribs 16 and 17 which function to provide greater rigidity to the wall liner, and provide embedment locks and attachment points to stabilizing wall ties 20. The preferred form of embedment ribs 16 and 17 is shown in FIGS. 1, 2 and 6. The stabilizing wall ties 20 preferably extend through openings formed in embedment ribs 16 and 17. The "Y" shape will become embedded and thereby secured in the concrete.

Openings 21 are provided through side walls 11 and 12 through which dowel bars of the dowel bar assembly extend. The dowel bar assembly depicted in FIGS. 1 and 2 is conventional. It typically includes steel dowel bars 23 extending transversely to the joint and a series of supporting bars or chairs 27 to locate the rods before the concrete is extruded. One end of each dowl bar is conventionally fixed in the concrete and the other end is free, due to a coating which prevents concrete adherence. Preferably, openings 21 are punched through side walls 11 and 12 when hinge 13 is open. A drainage trough receiving channel 22 is formed throughout the length of the wall liner 10 along the interior of base feet 15.

An open joint guide channel 24 is defined between hinge 13, side walls 11 and 12 and guide channel projections 25. An open cell 26 is defined between side walls 11 and 12, guide channel projections 25 and open cell projections 28.

Compression blocks 30 are placed in open cell 26 between each dowel bar extending through the wall liner 10. For drawing clarity, the blocks 30 are not shown in FIG. 2 in open cell 26. Blocks 30 may be molded or bonded to wall liner 10. The compressions blocks are preferably of a resilient thermoplastic, high density material with resistance to road chemical deterioration. The most preferred material is a natural rubber which compresses to about 60% of its original dimension when subjected to about 750 pound per square inch of pressure. It should rebound to at least 90% of its original dimension when pressure is released. Preferably, the natural rubber rebounds to about 98% of its original dimensions.

Preferably, compression blocks 30 are fabricated with a hinge 31 at the upper end serving to absorb opening and closing of the joint area during expansion and contraction of the adjacent concrete panels. Hinge 31 also restricts non-compressible materials from migrating between compression block walls.

Compression blocks 30 are slightly spaced from each other to define vertical openings 33 to allow moisture, chemicals and non-compressibles to pass freely to drainage trough 35. Non-compressibles, as referred to herein, refers to concrete chips, loose aggregate and sand.

Drainage trough 35 is preferably snapped or slid in a telescoping manner into drainage trough receiving channel 22. Preferably, drainage trough 35 includes enlarged edges 40 and 41 conforming in size and shape to channels 22. Drainage trough 35 thereby forms a lower gutter which directs moisture and chemicals to adjacent edge drainage systems. Drainage trough 35 is accessible at both ends to permit periodic removal of non-compressible material therewithin by flushing or vacuum cleaning. Preferably, drainage trough 35 is elevated so as not to directly contact the subgrade. Raising the trough prevents damage due to frost heave.

Preferably, drainage trough 35 is field formed of a thermoplastic tape into a rounded gutter. Such a design allows the construction of a seamless drainage trough 35.

Dowel bars of the conventional dowel bar assemblies extend through wall liner 10 through openings 21. A dowel bar seal 36 is preferably provided as shown in FIGS. 2, 2*a* and 2*b*, consisting of a rigid plastic cylinder 37 and pliable plastic conical grommet seals 38, 39 which extend through openings 21 as shown in FIG. 3. Preferably, conical grommet seals 38 and 39 snap fit into openings 21.

The dowel bar seal 36 may be secured to the wall liner 10 and dowel bar by clamps, adhesives or the like. Liquids passing into open cell 26 do not contact and deteriorate the steel dowel bars due to dowel bar seals 36. The conical grommet seals 38, 39 also reduce stress along adjacent walls of the transverse joint during load transfer from slab to slab caused by the bending moment of the steel dowel bars.

Stabilizing ties 20 are preferably attached to embedment ribs 16 and 17 as shown in FIGS. 1 and 2. Stabilizing ties 20 are attached to the dowel bar assembly at one end and the embedment ribs 16, 17 at the other end. The stabilizing ties provide additional support for the joint cell.

As shown in FIG. 6, several wall liners 10 may be joined together when paving widths which are greater than the length of a single wall liner 10. Pavement lanes are typically about twelve feet wide. Single wall liners 10 would typically be extruded in twelve foot sections. Connector section 50 includes base feet 51, two symmetrical side walls 53, 54 and embedment rib channel locks 56 and 57. The connector section 50 is preferably of extruded plastic and may be formed with an upper hinge point as in wall liner 10. Embedment rib channel locks 56 and 57 are designed to snap fit or slidably engage with embedment ribs 16 and 17, thereby holding two wall liners 10 together at their respective ends.

Figure 4:
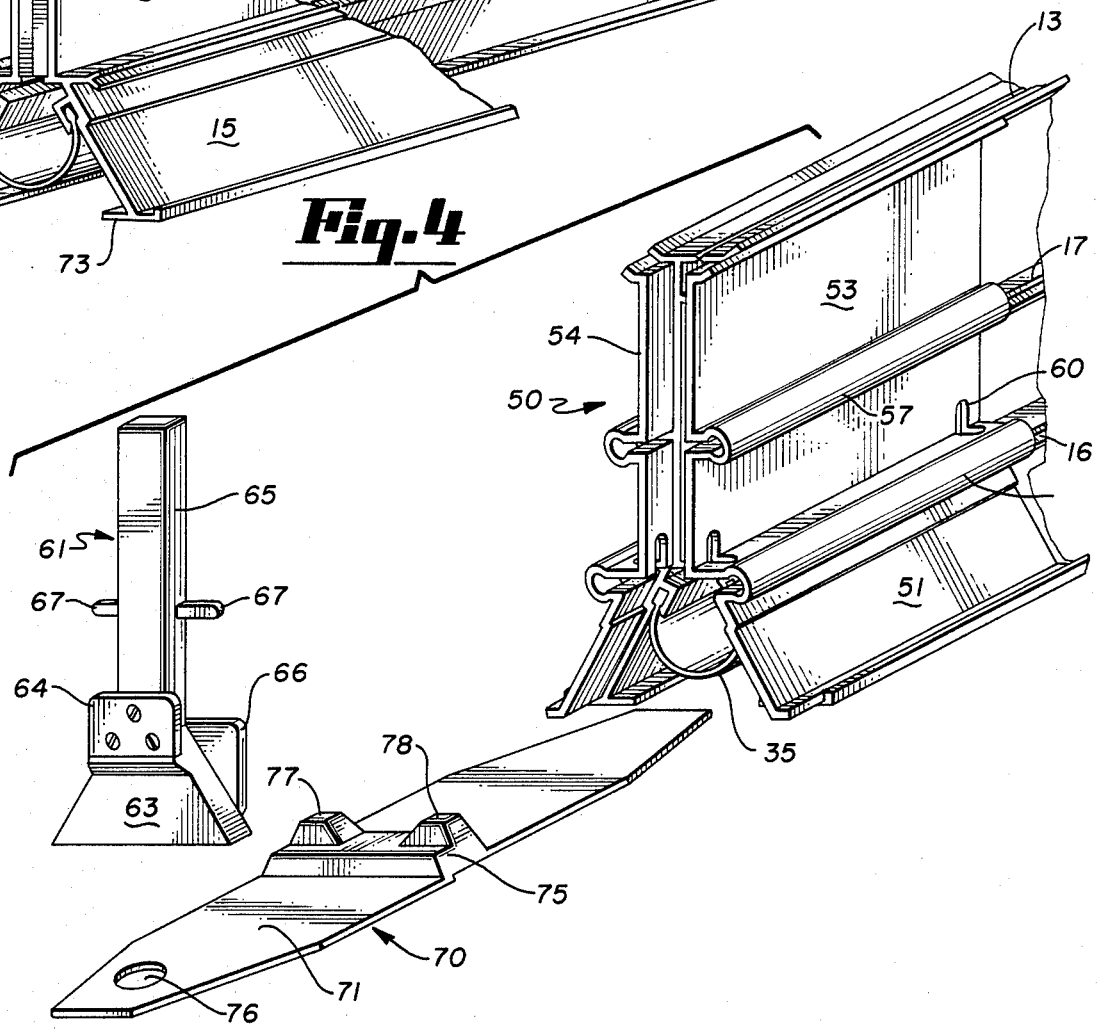
FIG. 4 is an exploded view in pictorial in cabinet projection of an end connector assembly.
Figure 5:
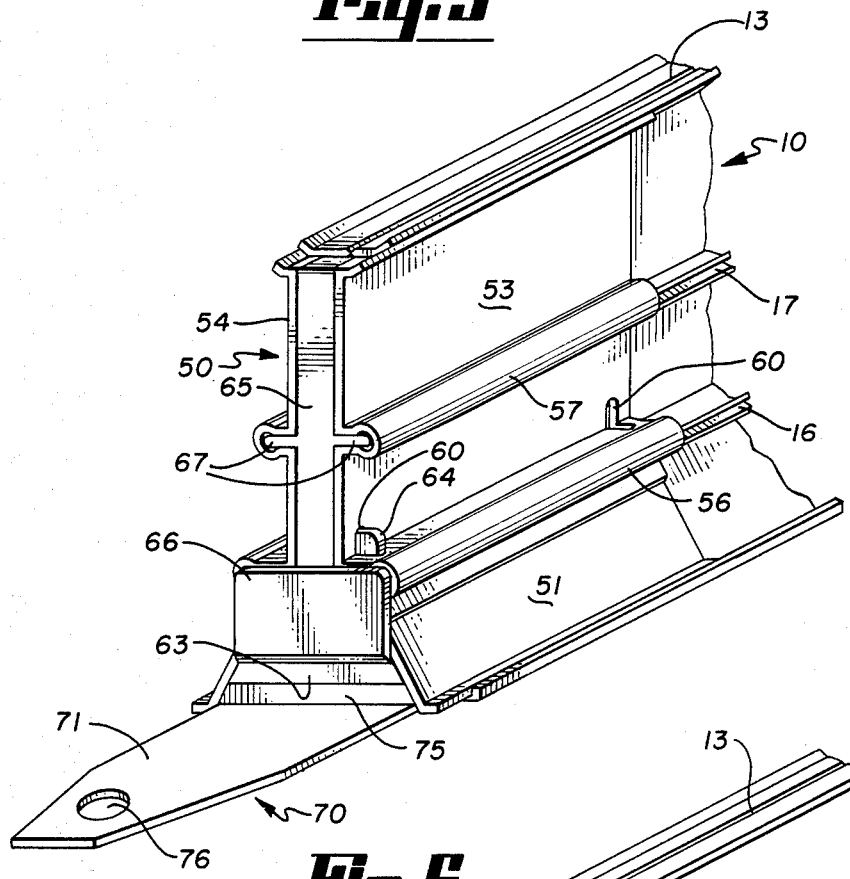
FIG. 5 is a pictorial view in cabinet projection of an assembled end connector assembly.

Connector section 50 preferably include slots 60 adjacent each end as shown in FIGS. 4, 5, and 6 for use as a retractable end section. An end cap 61 including a base 63, end cap tab 64, post 65 and rotation stop tabs 67 is designed to insert into an end of connector section 50. Post 65 fits inside side walls 53, 54, with rotation stop tabs 67 inserted into embedment rib channel locks 57.

A reusable finder tab 70, as shown in FIGS. 4 and 5 is used with end cap 61 and connector section 50 to locate transverse joint cells of the invention after the concrete has been poured and to lock end cap tab 64 into slots 60. Finder tab 70 includes a tab base 71 constructed and arranged so as to slide along the horizontal surface defined by inner extensions 73 of wall liner base feet 15.

Preferably, each transverse joint cell includes a connector section 50 at each end of wall liner 10 at the edge of the pavement. When the end cap base 63 rests on tab base 71, the end cap tab 64 does not engage slots 60. However, when finder tab 70 is pulled outwardly from the connector section 50, end cap 61 is lifted onto a block up 75 formed on finder tab 70, locking end cap tab 64 into slots 60. A pair of ears 77 and 78 provide a back-up support for end cap 61. Preferably, an opening 76 is formed in finder tab 70 to provide a finger pull point to facilitate movement of finder tab 70. The end cap tab 64 is preferably formed of metal. End cap plate 66 of the end cap 61 functions to seal the end of connector section 50.

When the concrete has been poured over the transverse joint cell, a vibrating joint forming head (not shown) is pulled through open joint guide channel 24. The joint forming head completes the pavement joint by splitting apart hinge 13, which is readily split with the knife-edge of a joint forming head, and excluding uncured concrete from the area above the transverse joint cell.

Connector sections 50 at each end of wall liner 10 are pulled out to the pavement edge before the concrete has cured. Preferably, connector sections 50 are pulled using finder tabs 70 and end caps 61 which may then be removed.

When the concrete has cured, a saw is utilized to true the concrete walls of the joint. The hinge 13 portion of wall liner 10 is also opened by the saw. A conventional joint sealant, such as asphalt, fills the upper portion of the joint to resist the intrusion of noncompressible materials into the transverse joint. The top seal is preferably about one half an inch deep, formed on top of a polyethylene tape seal. When the conventional sealant filled upper joint begins to fail, the underlying transverse joint cell may be periodically flushed of accumulated debris. The drainage trough 35 is readily accessible from both sides of the completed pavement and may be cleaned with water under pressure, a vacuum or combination of both.

In considering this invention, it should be remembered that the present disclosure is illustrative only, and the scope of the invention should be determined by the appended claims.

We claim:

1. A transverse joint cell for concrete structures comprising:

elongated liner means for disposition between adjacent end portions of end to end concrete road slabs;

said liner means including a pair of vertically extending panels spaced apart in substantially parallel relation such that a plurality of compressible blocks may be inserted therebetween;

said liner means further including gutter means extending longitudinally between said vertically extending panels and therebetween in position to collect and drain away fluid which may pass downwardly therebetween;

a plurality of compressible resilient blocks disposed between said vertically extending panels throughout the portions thereof intermediate the ends of said panels in spaced apart relation so as to provide vertical drainage openings to allow fluid to pass to said gutter means; and means for securing said liner means to a dowel bar assembly of said concrete road slabs.

2. The transverse joint cell of claim 1 wherein said means for securing said liner means to such a dowel bar assembly includes stabilizing ties and includes apertures in said vertically extending panels for receiving said dowel bars therethrough.

3. The transverse joint cell of claim 2 wherein said stabilizing ties are secured to embedment ribs forming a portion of each panel and extending longitudinally of said vertically extending panels and said dowel bar assembly.

4. The transverse joint cell of claim 3 wherein a plurality of vertically extending panels are joined longitudinally by a connector section which includes a pair of vertically extending connector panels constructed and arranged so as to snap fit over said embedment ribs of said liner means vertically extending panels.

5. The transverse joint cell of claim 3 wherein a plurality of liner means lengths are constructed and arranged to be joined at their respective ends by a connector means.

6. The transverse joint cell of claim 5 wherein said connector means includes a pair of side walls constructed and arranged to telescopingly engage said embedment ribs of the vertically extending panels.

7. A retractable end section in combination with the transverse joint cell of claim 3, said retractable end section including a pair of side walls each constructed and arranged to telescopingly engage at least one of the embedment ribs of the vertically extending panels.

8. The retractable end section of claim 7 wherein an end cap is constructed and arranged to be removably mounted between said pair of side walls so as to exclude the introduction of uncured concrete into the end of said transverse joint cell while in position during the laying of the concrete slabs.

9. The end cap of claim 8 wherein said side walls include notch means and said end cap includes latching means positioned to engage said notch means whereby lateral movement of said cap along the longitudinal axis of said transverse joint cell will move said side walls in a lateral direction.

10. The combination of claim 9 wherein a finder tab is constructed and arranged to hold said end cap in locking engagement with said retractable end section, said finder tab having projections therefrom engaging a portion of said end cap.

11. The transverse joint cell of claim 1 wherein said vertically extending panels are formed of extruded thermoplastic, said panels being formed with an upper hinge means joining the upper edges of said panels to each other.

12. The transverse joint cell of claim 1 wherein said compressible blocks are formed of resilient thermoplastic material.

13. The transverse joint cell of claim 12 wherein said resilient thermoplastic material is a natural rubber which is compressible to about 60% and rebounds to at least about 90% of its original dimensions.

14. The transverse joint cell of claim 1 wherein said vertically extending panels include channels and said gutter means comprises a seamless drainage trough constructed and arranged to slidably engage said channels, said trough being elevated above the subgrade of said concrete road slabs.

15. The transverse joint cell of claim 1 wherein said vertically extending panels are constructed and arranged with an upper concrete-impermeable joint.

16. The transverse joint cell of claim 15 wherein said upper concrete-impermeable joint includes a longitudinally extending hinge which may be readily split with a blade.

17. In combination with adjacent slabs of pavement separated by a joint space:

wall liner means including elongated spaced panels extending parallel to each other;

support means to support said liner means on a substantially flat surface within such a joint space;

seamless drainage means extending between said elongated spaced panels throughout the length of said joint space, said wall liner means having accessible outlets at each ends of the joint; and a plurality of compressible resilient block means disposed between said panels and spaced throughout the length of said panels for compensating for expansion and contraction of such adjacent slabs of pavement, said block means being constructed and arranged to allow fluids to pass downwardly therebetween to said drainage means.

18. A transverse joint cell to be used for compensation for expansion and contraction of end to end panels of a concrete road comprising:

water impermeable liner means comprising a pair of vertically extending side walls constructed and arranged to be spaced apart in substantially parallel relation between the ends of such panels such that a plurality of compressible blocks may be inserted therebetween;

said side walls being constructed and arranged to define an upper longitudinally extending void to provide a guide for an upper joint forming head;

means for supporting said liner means between such end to end concrete panels;

spaced compressible block means formed of an elastomer for absorbing compression due to expansion of such adjacent concrete panels and disposed between and throughout the portions thereof intermediate the ends of said vertically extending side walls in spaced apart relation so as to allow fluids and noncompressibles to pass downwardly therebetween; and a seamless drainage trough extending longitudinally of said side walls and said expansion joint and below said compression block means in fluid tight relation to said liner means.

19. A transverse joint cell comprising:

a water-impermeable liner means disposed between adjacent transverse joint edges of concrete pavement, said liner means defining an open cell therebetween;

support means for supporting said liner means;

compressible resilient block means for absorbing compression due to expansion of adjacent concrete panels, and disposed between and throughout the length of said liner means and being constructed and arranged to allow fluids to pass freely downwardly in the joint cell; and seamless drainage trough means extending transversely through said open cell and in fluid tight relation to said liner means and being constructed and arranged below said compression block means.

20. The transverse joint cell of claim 19 wherein said liner means is formed as a single extrusion of polypropylene and is comprised of a pair of vertically extending panels spaced apart in substantially parallel relation, the upper edges of said vertically extending side joined by a concrete-impermeable hinge means formed in the extrusion.

21. The transverse joint cell of claim 19 wherein said liner means includes panels having juxtapositioned openings through which dowel bars of a dowel bar assembly may extend.

22. The transverse joint cell of claim 21 wherein said dowel bars extends through said juxtapositioned openings including means for forming a water-impermeable seal between said opening and said dowel bars extending therethrough.

* * * * *